US005428933A

United States Patent [19]

Philippe

[11] Patent Number: 5,428,933

[45] Date of Patent: Jul. 4, 1995

[54] INSULATING CONSTRUCTION PANEL OR BLOCK

[76] Inventor: Michel Philippe, 2840 Bouvier Rd., Hammond, Ontario K0A 2A0, Canada

[21] Appl. No.: 195,017

[22] Filed: Feb. 14, 1994

[51] Int. Cl.[6] ..... F04C 3/02

[52] U.S. Cl. ..... 52/592.1; 52/309.12; 52/426; 52/564; 464/85; 464/124

[58] Field of Search ..... 52/592.1, 592.2, 592.5, 52/592.6, 596, 564, 565, 568, 578, 309.12, 309.15, 426, 427, 428; 464/85, 106, 108, 124, 125

[56] References Cited

U.S. PATENT DOCUMENTS

| | | | |
|---|---|---|---|
| 3,895,469 | 7/1975 | Kapitan | 52/592.5 |
| 4,229,920 | 10/1980 | Lount | 52/309.12 |
| 4,706,429 | 11/1987 | Young | 52/564 |
| 4,884,382 | 12/1989 | Horobin | 52/426 |
| 4,885,888 | 12/1989 | Young | 52/564 |
| 4,894,969 | 1/1990 | Horobin | 52/309.12 |
| 5,060,446 | 10/1991 | Beliveau | 52/592.1 |
| 5,122,015 | 6/1992 | Shen | 52/592.6 |
| 5,163,261 | 11/1992 | O'Neil | 52/592.6 |

*Primary Examiner*—Carl D. Friedman
*Assistant Examiner*—Winnie S. Yip
*Attorney, Agent, or Firm*—McFadden, Fincham

[57] ABSTRACT

The present invention discloses an insulating construction member having top and bottom edges and interconnecting members on the top and bottom edges. The interconnecting members comprise alternating projections and recesses, the projections and recesses being of substantially the same dimension. The interconnecting members on the top and bottom edges are symmetrically arranged whereby the insulating construction member can be interconnected with a like member in a bi-directional or reversible manner.

18 Claims, 6 Drawing Sheets

INSULATING CONSTRUCTION PANEL OR BLOCK

BACKGROUND OF THE INVENTION

1. Field of the Invention

The present invention relates to interlocking insulating construction panels or blocks. More particularly, the present invention relates to an insulating construction block or panel having interconnecting means having a symmetrical pattern which permits the interconnecting with like blocks or panels in a bi-directional and/or reversible manner.

2. Description of the Prior Art

U.S. Pat. No. 4,229,920 discloses a foamed plastic concrete form which includes projecting tongues on one end and on one side and a corresponding groove on the opposite end and upon the opposite side edges so that adjacent forms can be interlocked in end to end relationship and will also interlock when placed one above the other. In such an arrangement, the forms will only interlock when placed in a bottom to top arrangement, i.e. the blocks must be arranged in a specific orientation for interconnection; this patent does not permit the bidirectional or reverse interlocking of forms.

U.S. Pat. No,. 4,894,969 discloses an insulating block form for constructing concrete wall structures including interlocking means to permit stacking of the blocks one on top of the other. The construction of this patent does not permit the stacking of a plurality of blocks in a reversible or a bi-directional manner.

SUMMARY OF THE INVENTION

Preferred embodiments of the present invention provide for an insulating construction panel or block which is designed in such a manner to permit its interconnection with like panels or blocks in a bi-directional and/or reversible manner. Such a construction member is much easier to interconnect with like members, as there are a plurality of ways the members can be interconnected and this thus allows installers to proceed at a much faster pace then possible with previously known insulating construction panels or blocks. Further, with such insulating construction members, there is less waste as cut portions, for example portions cut for window or door openings, can be utilized anywhere due to the special interconnection means which permits bi-directional and/or reversible interconnection.

In accordance with an embodiment of the present invention there is provided an improved insulating construction member having top and bottom edges and interconnecting means on the top and bottom edges. The improvement wherein the interconnecting means comprise alternating projections and recesses, the projections and recesses being of substantially the same dimension, and wherein the interconnecting means on said top and bottom edges are symmetrical whereby the construction member can be interconnected with a like member in a bi-directional and/or reversible manner.

The insulating construction member can be in the form of an insulating construction block or an insulating construction panel.

In accordance with yet another embodiment of the present invention there is provided an insulating construction block comprising: a pair of substantially parallel side members having top and bottom edges; at least one web interconnecting the side members; interconnecting means on the top and bottom edges, the interconnecting means including at least one row of alternating projections and recesses, the projections and recesses having substantially the same dimensions. The interconnecting means on the top and bottom edges are substantially symmetrical whereby the insulating construction block can be interlocked with a like block in a bi-directional and/or reversible manner.

In a preferred form the construction block of the present invention includes end pieces which may preferably be readily inserted and removed from the block by way of a sliding tongue and groove type arrangement. In this respect the side members may have grooves for slidably receiving projections on the ends of the end pieces. Any other suitable arrangement may be utilized. The end pieces may also be integral with the block if desired.

Preferably, the interconnection means on the top and bottom edges of the insulating construction panel or block includes two rows of alternating projections and recesses. Where two rows of alternating projections and recesses are provided, preferably the adjacent pairs of each row are opposites, i.e. a recess of one row is preferably adjacent a projection of the other row. Such an arrangement provides for a stronger interconnection between like insulating members.

There may also be provided sealing means positioned between the rows of alternating projections and recesses. Such a sealing means is preferably in the form of a raised portion which extends along the length of the interconnection means and which is of a height less than the height of the projections, preferably about one-half the height of the projections.

The interconnecting means preferably extend along the entire length of the top and bottom edges of the insulating member although it is not necessary that the interconnecting means extend along the entire length as they may be present in just one or more sections.

The projections and recesses of the interconnecting means are of substantially the same shape and dimensions and, in one preferred form, are of a rectangular configuration, although it will be understood that any other configuration can be utilized, such as, for example, circular, square, triangular, polygonal, etc.

In a preferred form of the insulating construction members of the present invention, each of the projections and recesses preferably have a tapered configuration. For example, in the case of a rectangular projection, the side walls of the projection are preferably provided with a tapered outline running from the free top side walls towards the bottom wall connected to the main body of the insulting member. Preferably, at least two opposed walls of a rectangular configuration are provided with the tapered construction; all four side walls of the rectangular projection could be provided with such a feature.

In a like manner, the recesses will correspondingly be of a tapered construction where the two opposed walls of the projections are opposed walls extending in the axial direction of the insulating member. Such a tapered recess construction would be the reverse configuration where the recesses have a broader or wider open top tapering to a narrower bottom construction.

This preferred tapered construction permits an easier assembly of one insulating member onto another like member during usage.

It is a particularly preferred feature that the interconnecting means have projections and recesses which have a substantially conical configuration.

Preferably, in the case of an insulating construction block, the side members and interconnecting means are of a one-piece integral configuration, although it will be understood that the interconnecting means and the side members can be formed separately and joined together.

In the case of an insulating panel, it is preferred that the panel and the interconnecting means are of a one piece integral configuration; although, as in the case of the insulating block, the panel and the interconnecting means can be formed separately and joined together.

In the insulating block arrangement, preferably the interconnecting web is of a rigid material or at least non-extensible material. Although the web can be formed from any suitable material including various types of metals, preferably the web is formed of a suitable synthetic polymeric material.

Typical polymeric materials are those known in the art including polymers and copolymers of various types e.g. polyethylene or copolymers thereof, polypropylene or copolymers thereof, polystyrene or copolymers thereof, etc.

The polymer may be a foamed polymer, or more generally, such webs are formed of non-foamed material.

The structural configuration of the web can also very considerably; generally, the web includes anchoring means for anchoring the respective ends of the web into the foam blocks. In addition, the web may be formed of two or more sections so that an adjustable web can be utilized to form blocks of varying width.

The number of webs in a typical block will vary depending on the size and dimensions of the block; typically, small blocks may have one or two webs with up to 10 or more webs on standard (one meter) size blocks.

The insulating construction members of the present invention are preferably formed of a foamed material, such as any of the foamed polyolefins, e.g. polyethylene, polypropylene, etc. or other foamed polymers which find use in the construction industry such as foamed styrene polymers and copolymers, foamed urethanes, etc.

The design of the insulating construction member of the present invention in preferred forms permits the member to be interconnected with a like member in any of a plurality of positions. More specifically the members are bi-directional and reversible which means that there is not only one right way to interconnect the members, i.e. they do not have to be interconnected in one particular way such as bottom to top. Such an arrangement allows installers to proceed at a much faster pace than previously possible as they do not have to orient the members in one certain way for interconnection. Also, such an arrangement creates less waste, i.e. a portion cut for forming a window or door opening, for example, can be utilized anywhere in the construction due to the symmetry of the interconnecting means.

In some embodiments of the present invention, the blocks may also be mounted, one to another, at right angles to each other. Thus, not only do such blocks of such embodiments have the capability of reverse and bidirectional mounting, but further, mounting perpendicularly to each other.

The insulating panels or blocks may be of the standard straight configuration or may be angled corner units. A corner unit would have the same interconnecting means above specified, i.e. a pattern of alternating projections and recesses substantially the same shape and dimensions, the pattern on the top being symmetrical with the pattern on the bottom. With such a corner unit a single corner unit can be utilized for either the left or the right hand corner by simply reversing the unit. Thus the corner units would also be bi-directional and reversible. Similar arrangements apply to "T" shaped insulating members as well as "x" shaped insulating members.

BRIEF DESCRIPTION OF THE DRAWINGS

Having thus generally described the invention, reference will now be made to the drawings which illustrate preferred embodiments of the invention, wherein.

DETAILED DESCRIPTION OF PREFERRED EMBODIMENTS

Figure 1:
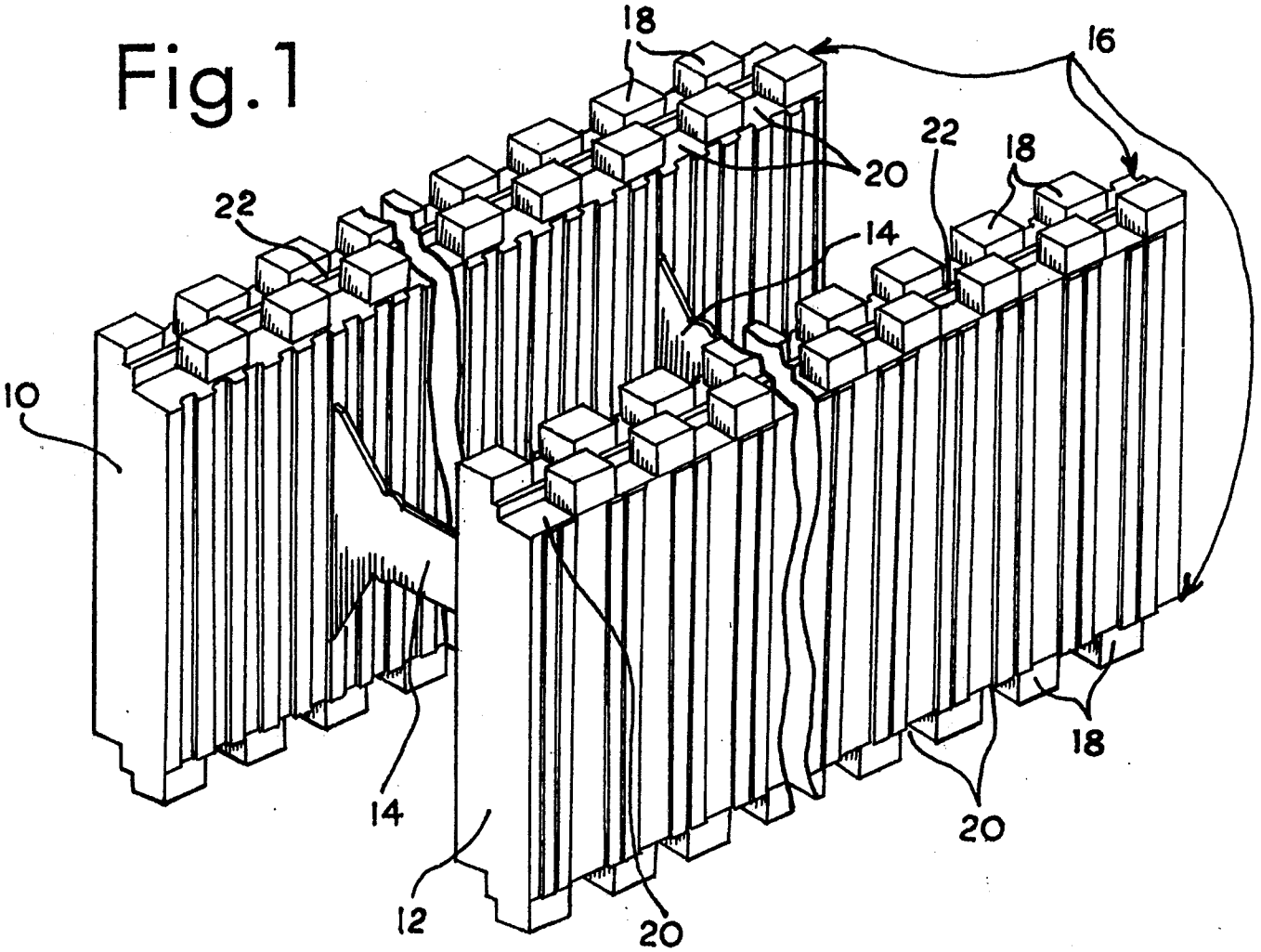
FIG. 1 is a perspective view of an insulating block according to one embodiment of the present invention.

Reference will initially be made to FIG. 1 of the drawings which illustrates a preferred embodiment of an insulating construction block of the present invention. The insulating construction block includes a pair of generally parallel panels or side walls 10, 12. Side walls 10, 12 are joined together by webs 14. Interconnection means 16 are provided on the top and bottom edges of the side walls 10, 12.

The interconnection means 16 permit the stacking and interconnection of a plurality of like blocks as would be required in the construction of a wall or similar arrangement. The interconnection means 16 include a plurality of projections 18 and recesses 20 arranged in an alternating pattern; the projections 18 and recesses 20 being of substantially the same shape and having substantially the same dimensions. The interconnection means 16 on the top and bottom edges of the side walls 10, 12 are substantially symmetrical, thereby permitting the interconnection of like blocks in a bi-directional and/or reversible manner. In the preferred embodiment illustrated in FIG. 1, the interconnection means 16 include two rows of alternating projections 18 and recesses 20; although other arrangements can be utilized as will be described later with reference to FIGS. 3 through 6. When two or more rows of projections 18 and recesses 20 are utilized the projections 18 and recesses 20 must alternate in both the x and y axis, i.e. a projection 18 of one row must be adjacent to a recess 20 of the other row as well as being adjacent to a recess 20 in the same row. As noted above the interconnection means 16 of the top edge of the sides 10, 12 must be symmetrical with the interconnection means 16 of the bottom edge of the sides 10, 12. Such an arrangement permits the interconnection of like blocks in almost any orientation such as bottom to top, top to top as well as in either direction. In other words, the blocks are bi-directional as well as being reversible.

As best shown in FIG. 1, the interconnection means 16 may also include a sealing member 22. In the arrangement illustrated having two rows of projections 18 and recesses 20, the sealing member 22 is positioned therebetween and is in the form of a raised member which projects upwardly to a height less than the height of the projections 18. The sealing member 22 may also be positioned alongside of the projections 18 and recesses 20 of the interconnecting means 16.

Figure 2:
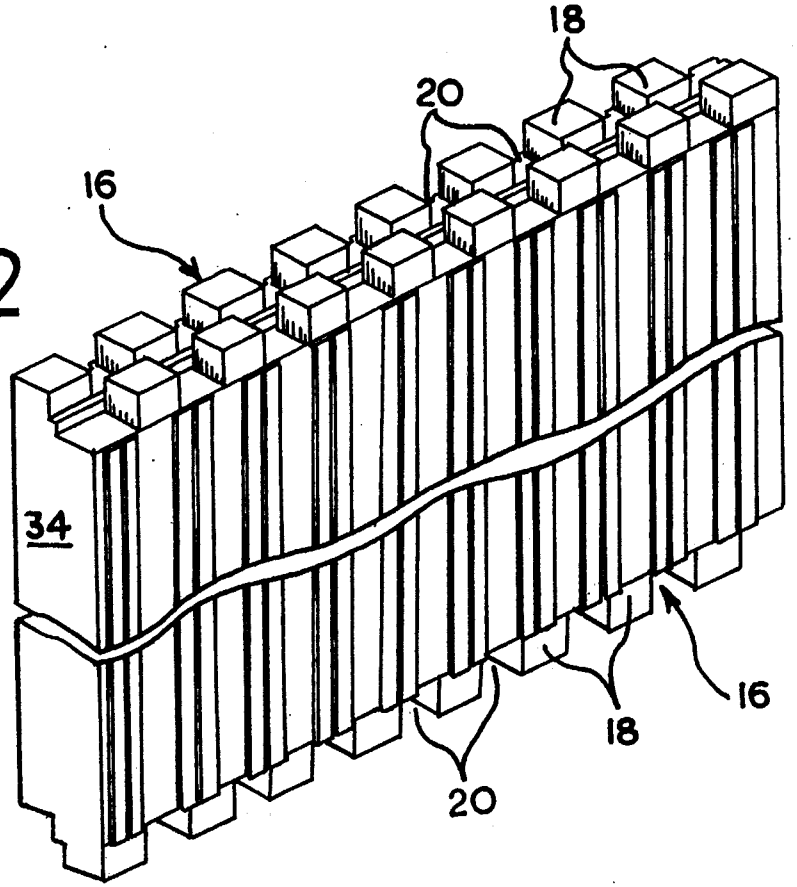
FIG. 2 is a perspective view of an insulating panel according to one embodiment of the present invention.

FIG. 2 illustrates an insulating panel according to an embodiment of the present invention. The insulating panel 34 includes interconnecting means 16. In the arrangement illustrated in FIG. 2, the interconnecting means 16 include a plurality of projections 18 and recesses 20 in an arrangement similar to the arrangement of interconnecting means 16 described with reference to the block of FIG. 1.

Figure 3:
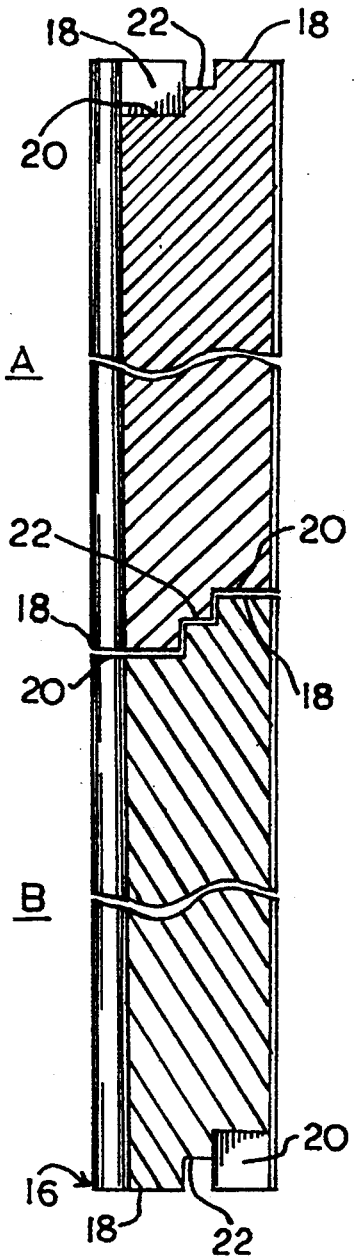
FIG. 3 is a cross sectional view of a pair of insulating panels interconnected together according to one embodiment of the present invention.
Figure 4:
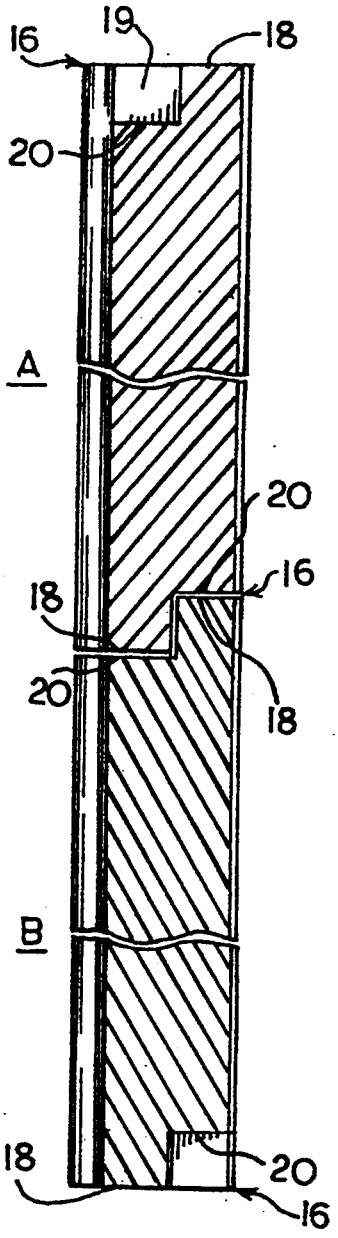
FIG. 4 is a cross sectional view of a pair of insulating panels interconnected together according to another embodiment of the present invention.
Figure 5:
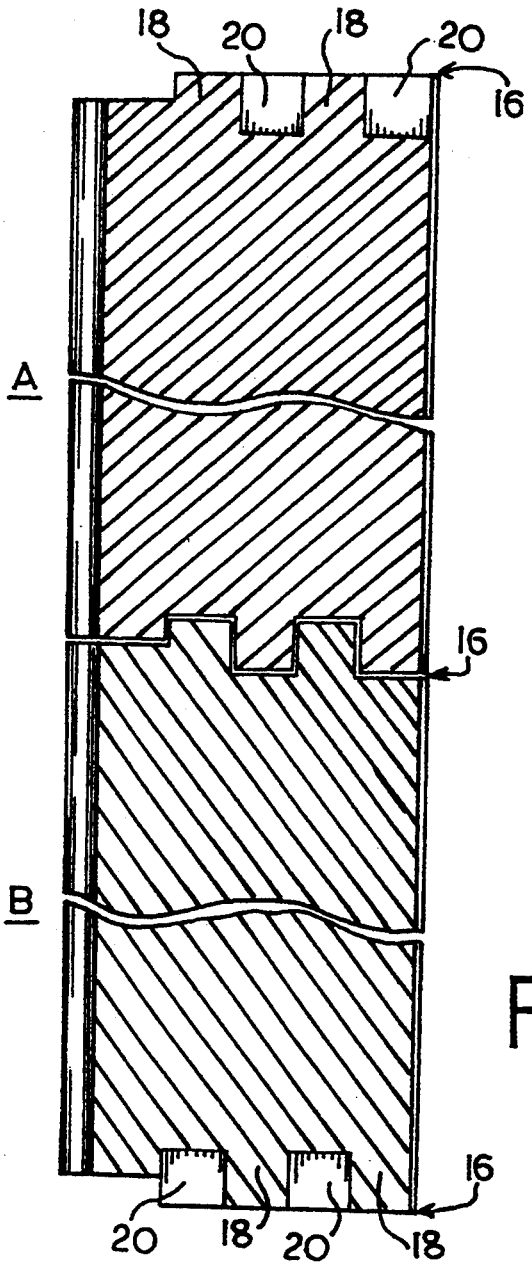
FIG. 5 is a cross sectional view of a pair of insulating panels interconnected together according to a further embodiment of the present invention.

FIGS. 3, 4 and 5 illustrate cross-sectional views of panels of two like members A and B interconnected together, the figures show various embodiments of the interconnection means 16.

FIG. 3 illustrates the arrangement of interconnecting means 16 as illustrated in FIG. 1, i.e. two rows of alternating projections 18 and recesses 20 with a sealing means 22 positioned therebetween.

FIG. 4 illustrates an arrangement of interconnecting means 16 which includes two rows of side-by-side alternating projections 18 and recesses 20. The arrangement of FIG. 4 does not include an extra sealing means.

FIG. 5 illustrates an arrangement where the interconnecting means 16 includes four rows of alternating projections 18 and recesses 20. The specific arrangement of interconnection means 16 in the embodiment illustrated in FIG. 5, permits the mounting of blocks in a perpendicular fashion in addition to bi-directional and reversible mounting.

Figure 6:
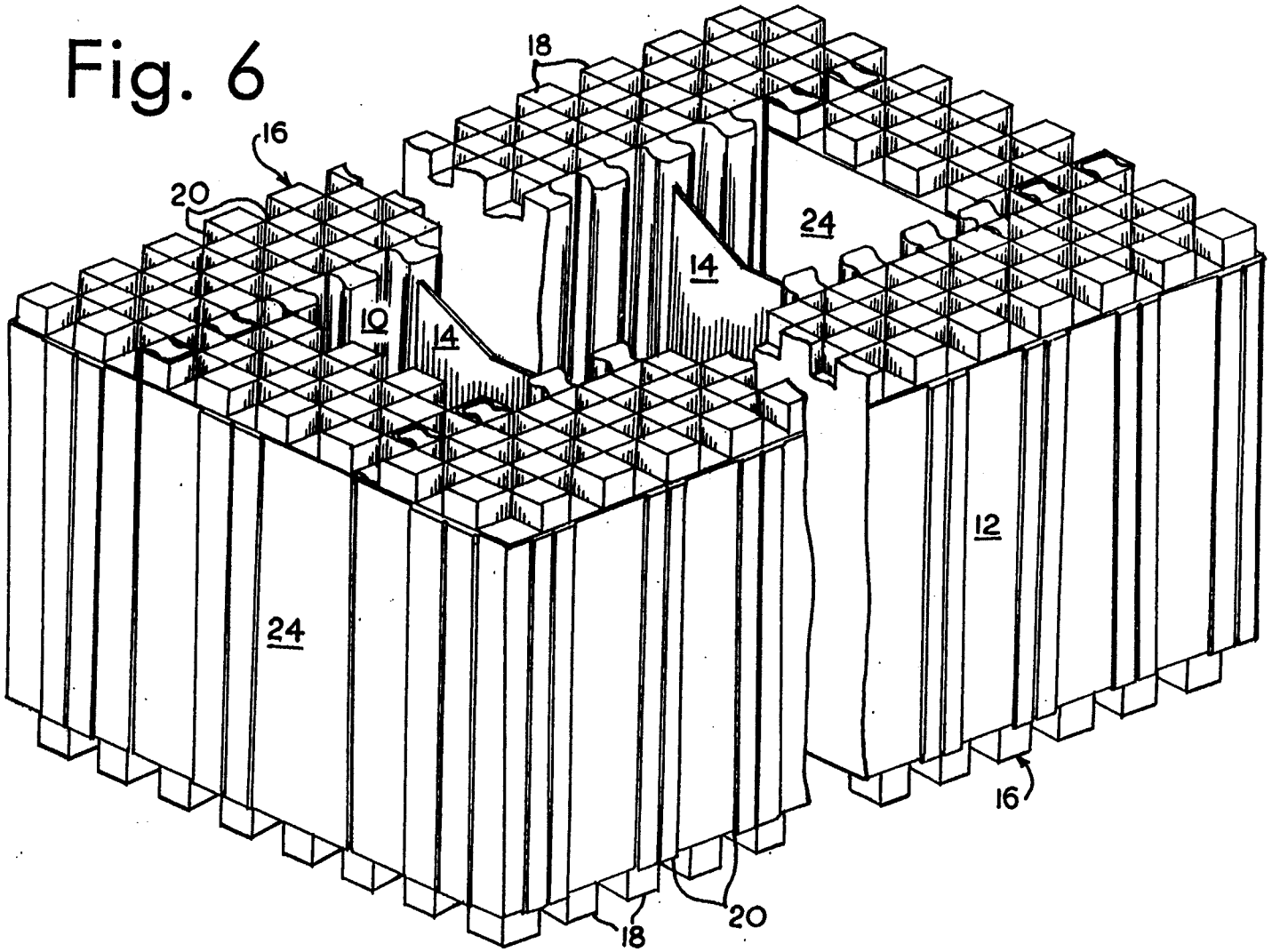
FIG. 6 is a perspective view of an insulating block of another embodiment of the present invention.

FIG. 6 illustrates an insulating block according to another embodiment of the present invention. In this arrangement the insulating block has a pair of generally parallel panels or side walls 10, 12 joined together by webs 14.

The interconnection means 16 of this embodiment includes four rows of alternating projections 18 and recesses 20. As discussed with respect to FIG. 5, the specific arrangement of interconnection means 16 in the embodiment illustrated in this figure, permits the mounting of blocks in a perpendicular fashion in addition to bi-directional and reversible mounting.

The block also includes end pieces 24 which are adapted for releasable engagement with the side members 10, 12. Such end pieces 24 are slidably and releasably inserted in the block by way of a tongue and groove arrangement. In this respect the side walls 10, 12 may include tongues or grooves (or both) on the inside surfaces which are adapted for mating engagement with tongues or grooves present on ends of the end piece 24; this feature is best illustrated in FIG. 7.

Figure 7:
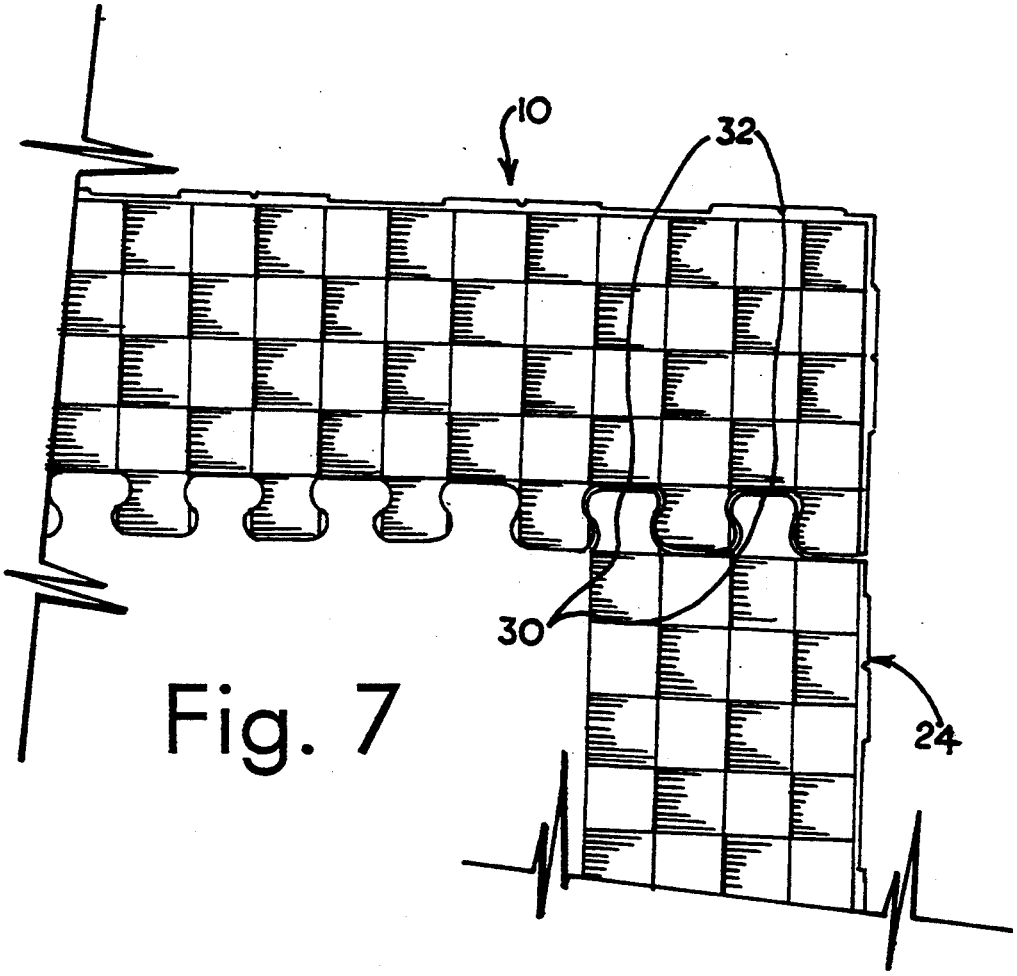
FIG. 7 is a top plan view of a portion of a side panel and end piece of an insulating block of the present invention showing their interconnection.

FIG. 7 is a top plan view of a portion of an insulating block (such as that illustrated in FIG. 6) illustrating the interconnection between a side wall 10 with the end piece 24. As illustrated, the end piece 24 includes projections 30, which are slidably received in grooves 32 on an inside surface of the side wall 10.

Having described preferred embodiments of the present invention, it will be understood that various modifications can be made to the above embodiments without departing from the spirit or scope of the invention.

I claim:

1. In an insulating construction member having top and bottom edges and interconnecting means on said top and bottom edges, the improvement wherein said interconnecting means comprise at least two rows of alternating projections and recesses, said projections and recesses being of substantially the same dimension, wherein said recess of one row is adjacent said projection of the other row, and wherein said interconnecting means on said top and bottom edges are offset arranged such that said recess of one row on said top edge is opposed to said projection of an opposite row of said bottom edge; whereby said insulating construction member can be interconnected with a like member in a bi-directional or reversible manner.

2. An insulating construction member according to claim 1, wherein said member is an insulating construction block.

3. An insulating construction member according to claim 1, wherein said member is an insulating construction panel.

4. An insulating construction member according to claim 1, wherein the interconnecting means includes an intermediate raised sealing member positioned between said rows of alternating projections and recesses.

5. An insulating construction member according to claim 1, wherein the interconnecting means includes a raised sealing member positioned adjacent to said rows of alternating projections and recesses.

6. An insulating construction member according to claim 1, wherein said member is comprised of a foamed material.

7. An insulating construction member according to claim 1, wherein said interconnecting means extend along the entire length of said top and bottom edges.

8. An insulating construction member according to claim 1, wherein said projections and recesses of said interconnecting means are of a rectangular configuration.

9. An insulating construction member according to claim 1, wherein said member has a configuration selected from the group consisting of straight, angled, T-shaped or X-shaped.

10. An insulating construction member according to claim 1, wherein said member is formed of a formed polymeric material.

11. An insulating construction block comprising:

a pair of substantially parallel side members having top and bottom edges;

joining means interconnecting said side members;

interconnecting means on said top and bottom edges, said interconnecting means including at least two rows of alternating projections and recesses wherein said recess of one row is adjacent said projection of the other row, said projections and recesses having substantially the same dimensions;

wherein the interconnecting means on said top and bottom edges are substantially offset arranged such that said recess of one row on said top edge is opposed to said projection of an opposite row of said bottom edge; whereby said construction block can be interlocked with a like block in a bi-directional or reversible manner.

12. An insulating construction block according to claim 11, further including removable end pieces, said end pieces including end walls having projections and wherein said side members include grooves for slidably receiving the projections of said end pieces.

13. An insulating construction block according to claim 11, wherein said interconnecting means extend along the entire length of said top and bottom edges.

14. An insulating construction block according to claim 11, wherein said side members and said interconnecting means are of a one-piece integral configuration.

15. An insulating construction block according to claim 11, wherein said joining means is a web.

16. An insulating construction block according to claim 11, wherein said joining means comprises at least one web interconnecting said side members, said web comprising a synthetic material.

17. In an insulating construction member having top and bottom edges and interconnecting means on said top and bottom edges, the improvement wherein said interconnecting means comprises at least two rows of alternating projections and recesses, said projections and recesses being of substantially the same dimension and wherein said recess of one row is adjacent said projection of the other row, and an intermediate raised sealing member positioned between said rows of alternating projections and recesses, and wherein said interconnecting means on said top and bottom edges are offset arranged such that said recess of one row on said top edge is opposed to said projection of an opposite row of said bottom edge; whereby said insulating construction member can be interconnected with a like member in a bi-directional or reversible manner.

18. In an insulating construction member having top and bottom edges and interconnecting means on said top and bottom edges, the improvement wherein said interconnecting means comprise at least two rows of alternating projections and recesses, said projections and recesses being of substantially the same dimension and wherein said recess of one row in adjacent said projection of the other row, and a raised sealing member positioned adjacent to said rows of alternating projections and recesses and wherein said interconnecting means on said top and bottom edges are offset arranged such that said recess of one row on said top edge is opposed to said projection of an opposite row of said bottom edge; whereby said insulating construction member can be interconnected with a like member in a bi-directional or reversible manner.

* * * * *

US005428933C1

(12) EX PARTE REEXAMINATION CERTIFICATE (7747th)

United States Patent
Philippe

(10) Number: US 5,428,933 C1
(45) Certificate Issued: Sep. 21, 2010

(54) INSULATING CONSTRUCTION PANEL OR BLOCK

(75) Inventor: Michel Philippe, Hammond (CA)

(73) Assignee: Phil-Insul Corporation, Sarsfield, Ontario (CA)

Reexamination Request:
No. 90/006,433, Oct. 31, 2002

Reexamination Certificate for:

| | |
|---|---|
| Patent No.: | **5,428,933** |
| Issued: | **Jul. 4, 1995** |
| Appl. No.: | **08/195,017** |
| Filed: | **Feb. 14, 1994** |

(51) Int. Cl.
*E04B 2/28* (2006.01)
*E04B 2/40* (2006.01)

(52) U.S. Cl. ..... 52/592.1; 52/309.12; 52/426; 52/564; 52/6; 464/85; 464/124

(58) Field of Classification Search ..... 52/592.1, 52/592.2, 592.5, 592.6, 596, 564, 565, 568, 52/578, 309.12, 309.15, 426, 427, 428; 446/85, 446/106, 108, 124, 125
See application file for complete search history.

(56) References Cited

U.S. PATENT DOCUMENTS

| | | | | | |
|---|---|---|---|---|---|
| 4,884,382 | A | * | 12/1989 | Horobin | 52/426 |
| 5,060,446 | A | * | 10/1991 | Beliveau | 52/592.1 |
| 5,123,222 | A | | 6/1992 | Guarriello et al. | |
| 5,390,459 | A | * | 2/1995 | Mensen | 52/426 |

* cited by examiner

*Primary Examiner*—Phi Dieu Tran A

(57) ABSTRACT

The present invention discloses an insulating construction member having top and bottom edges and interconnecting members on the top and bottom edges. The interconnecting members comprise alternating projections and recesses, the projections and recesses being of substantially the same dimension. The interconnecting members on the top and bottom edges are symmetrically arranged whereby the insulating construction member can be interconnected with a like member in a bi-directional or reversible manner.

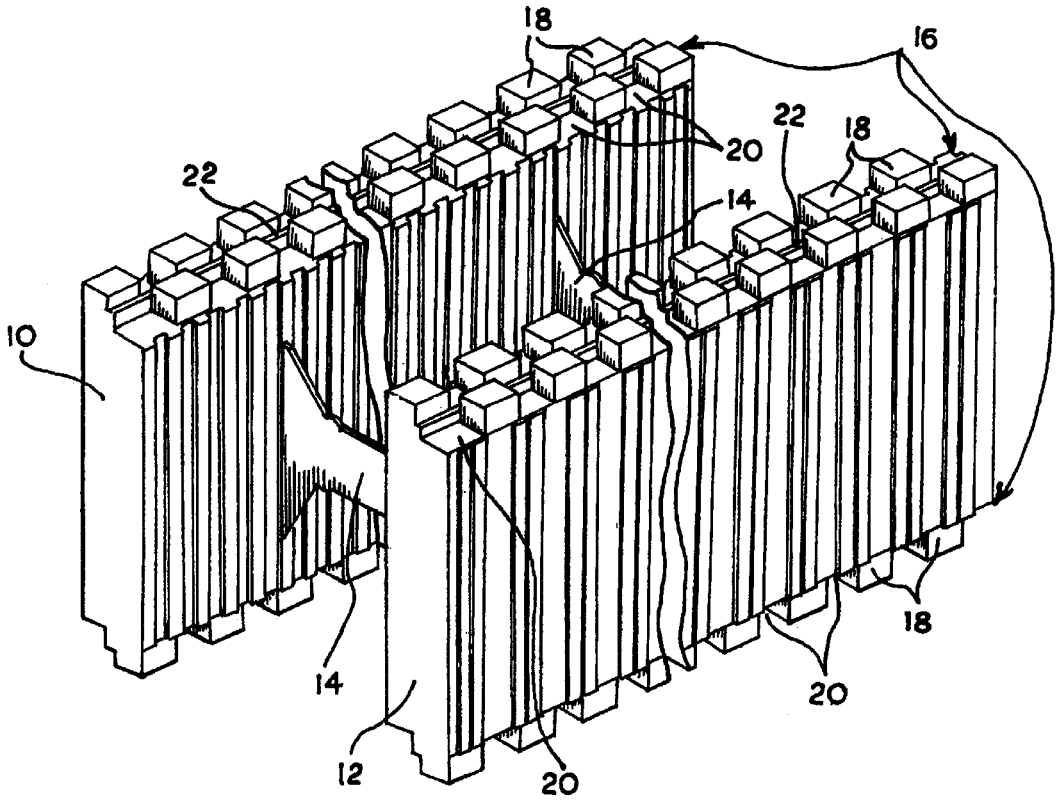

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 12, 17 and 18 are cancelled.

Claims 1-3, 6-8, 10, 11 and 13 are determined to be patentable as amended.

Claims 4, 5, 9 and 14-16, dependent on an amended claim, are determined to be patentable.

New claims 19-27 are added and determined to be patentable.

1. In [an] *a bi-directional and reversible* insulating construction member having *substantially planar ends and* top and bottom edges and interconnecting means on said top and *on said* bottom edges, the improvement wherein *each* said *top* interconnecting means [comprise] *and each said bottom interconnecting means has a pattern, each pattern comprising* at least two *longitudinally extending* rows of alternating, *continuous, immediately adjacent* projections and recesses, *extending continuously along the entire length of said top and bottom edges, the end projection in one row flush with at least a portion of one of said end planes, within each said pattern each of* said projections and recesses *in each one of said at least two rows within said pattern* being of substantially the same dimension, wherein *within each said pattern* said recess of one row is adjacent said projection of the other row, and wherein said interconnecting means *patterns* on said top and bottom edges are *the same and are* offset arranged such that said recess of one row *in said pattern* on said top edge is opposed to said projection of an opposite row [of] *in said pattern on* said bottom edge; whereby said insulating construction member can be interconnected with a like member in a bi-directional [or] *and* reversible manner.

2. An insulating construction member according to claim 1, wherein said member is an insulating construction block *comprising two panels, each of said panels having a pattern on the top and bottom edges, each of said patterns on each of said panels comprising at least one longitudinally extending row of alternating, continuous, immediately adjacent projections and recesses and each of said projections and each of said recesses within each said pattern in said at least one row being of substantially the same dimension.*

3. An insulating construction member according to claim 1, wherein said member is an insulating construction panel, *said panel having a pattern on the top and bottom edges, each of said patterns comprising at least two longitudinally extending rows of alternating, continuous, immediately adjacent projections and recesses, and each of said projections and each of said recesses within each said pattern in each one of said at least two rows within said pattern being of substantially the same dimension.*

6. An insulating construction member according to claim 1, wherein said member is comprised of a foamed material *and said projections are not directly attached to another projection.*

7. An insulating construction member according to claim [1] *8*, wherein said interconnecting means extend along the entire length of said top and bottom edges *and each of said projections is connected to the construction member on only one of the projection's six sides.*

8. An insulating construction member according to claim 1, wherein said projections and recesses of said interconnecting means are of a rectangular [configuration] *shape, each of said projections having six sides.*

10. An insulating construction member according to claim 1, wherein said member is formed of a [formed] *foamed* polymeric material.

11. [An] *A bi-directional and reversible* insulating construction block comprising:

a pair of substantially parallel side members having top and bottom edges *and substantially planar ends*;

joining means interconnecting said side members;

interconnecting means on said top and bottom edges, said interconnecting means *comprising a substantially identical pattern on the top and bottom edges, each pattern* including at least two *longitudinal* rows of alternating, *adjoining* projections and recesses *extending continuously along the entire length of said top and bottom edges, the end projection in one row flush with at least a portion of one of said end planes,* wherein said recess of one row is adjacent said projection of the other row, *within each said pattern each of* said projections and recesses *in each of said at least two rows within said pattern* having substantially the same dimensions *as each recess in each of said at least two rows and as each other projection in each of said at least two rows, each of said recesses in each of said at least two rows within said pattern having substantially the same dimension as each other recess in each of said at least two rows*;

wherein the *patterns on said* interconnecting means on said top and bottom edges are substantially offset arranged such that said recess of one row on said top edge is opposed to said projection of an opposite row of said bottom edge; whereby said construction block can be interlocked with a like block in a bi-directional [or] *and* reversible manner.

13. An insulating construction block according to claim 11, wherein *each of* said interconnecting means [extend] *extends* along the entire length of said top and bottom edges *and each of said projections and recesses is of square shape.*

*19. A bi-directional and reversible insulating construction block comprising:*

*a pair of substantially parallel side members having top and bottom edges and substantially planar ends;*

*joining means interconnecting said side members;*

*interconnecting means on said top and bottom edges, each said interconnecting means including substantially identical patterns including at least two longitudinal rows of alternating rectangular projections and recesses in each of said patterns, each row in each said pattern comprising more than one projection and more than one recess, with such alternating projections and*

*recesses being continuous along the entire length of said rows and contiguous one with another, the end projection in one row flush with at least a portion of one of said end planes, wherein said recess of one row in each said pattern is adjacent said projection of the other row in the same said pattern, within each said pattern, each of said projections and recesses in each one of said at least two rows having substantially the same dimensions;*

*wherein the interconnecting means patterns on said top and bottom edges are substantially offset arranged such that said recess of one row in said pattern on said top edge is opposed to said projection of an opposite row on said bottom edge; whereby said construction block can be interlocked with a like block in a bi-directional and reversible manner.*

*20. An insulating construction block according to claim 19, wherein said interconnecting means extend along the entire length of said top and bottom edges.*

*21. An insulating construction block according to claim 19, wherein said side members and said interconnecting means are of a one-piece integral configuration.*

*22. An insulating construction block according to claim 19, wherein said joining means is a web.*

*23. An insulating construction block according to claim 19, wherein said joining means comprises at least one web interconnecting said side members, said web comprising a material other than foamed polymeric material.*

*24. An insulating construction member according to claim 1, wherein said projections and recesses are of substantially the same shape.*

*25. An insulating construction block according to claim 11, wherein said projections and recesses are of substantially the same shape.*

*26. An insulating construction block according to claim 22, wherein said construction block is formed of polymeric material and a plurality of like blocks may be stacked to define a concrete wall having no through-hole openings filled only with foamed polymeric material.*

*27. An insulating construction block according to claim 19, wherein each side member is angled and said pair forms a corner unit that can be utilized for either a left or right hand corner.*

* * * * *

US005428933C2

(12) EX PARTE REEXAMINATION CERTIFICATE (10221st)

United States Patent
Philippe

(10) Number: US 5,428,933 C2
(45) Certificate Issued: Jul. 14, 2014

(54) INSULATED CONSTRUCTION PANEL OR BLOCK

(75) Inventor: Michel Philippe, Hammond (CA)

(73) Assignee: Phil-Insul Corporation, Sarsfield, Ontario (CA)

Reexamination Request:
No. 90/012,022, Jan. 3, 2012

Reexamination Certificate for:

| | |
|---|---|
| Patent No.: | **5,428,933** |
| Issued: | **Jul. 4, 1995** |
| Appl. No.: | **08/195,017** |
| Filed: | **Feb. 14, 1994** |

Reexamination Certificate C1 5,428,933 issued Sep. 21, 2010

(51) Int. Cl.
*E04B 2/28* (2006.01)
*E04B 2/40* (2006.01)

(52) U.S. Cl.
USPC ..... 52/592.1; 464/124; 464/85; 52/309.12; 52/426; 52/564

(58) Field of Classification Search
None
See application file for complete search history.

(56) References Cited

To view the complete listing of prior art documents cited during the proceeding for Reexamination Control Number 90/012,022, please refer to the USPTO's public Patent Application Information Retrieval (PAIR) system under the Display References tab.

*Primary Examiner* — Sara Clarke

(57) ABSTRACT

The present invention discloses an insulating construction member having top and bottom edges and interconnecting members on the top and bottom edges. The interconnecting members comprise alternating projections and recesses, the projections and recesses being of substantially the same dimension. The interconnecting members on the top and bottom edges are symmetrically arranged whereby the insulating construction member can be interconnected with a like member in a bi-directional or reversible manner.

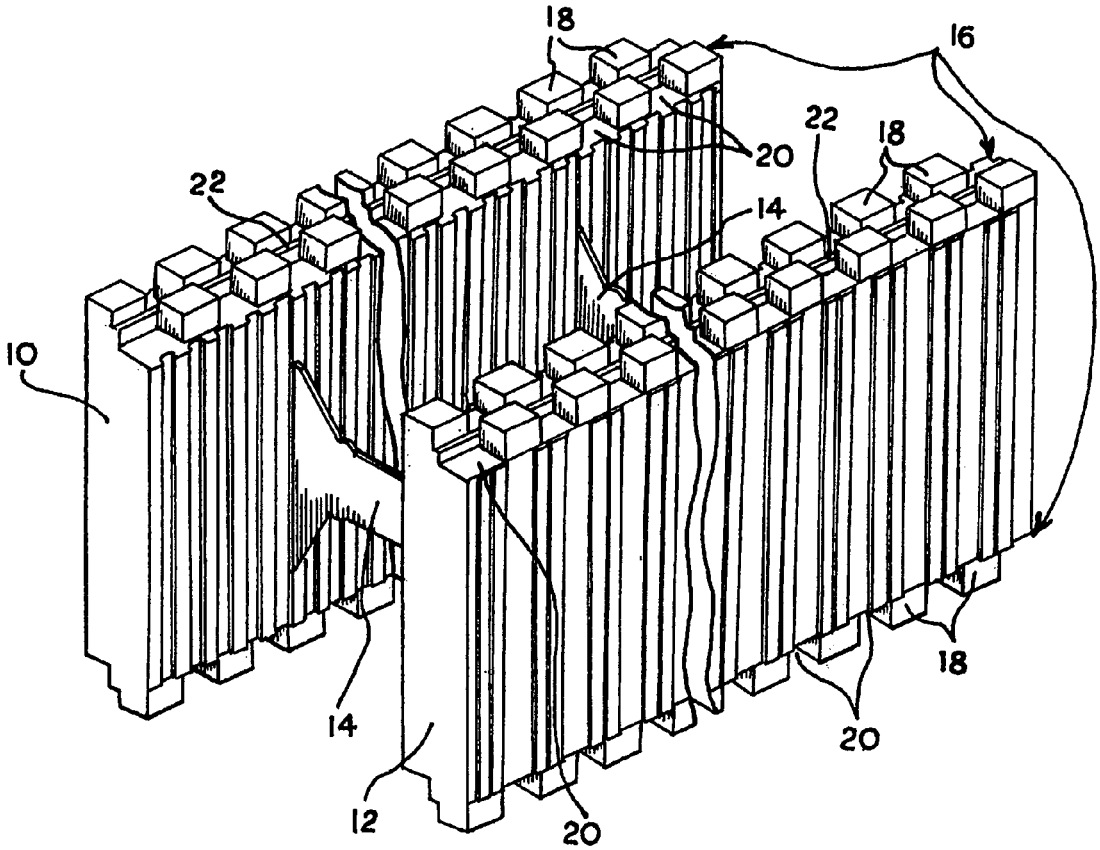

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 4, 5, 11, 13-16, 19-23 and 25-27 is confirmed.

Claims 12, 17 and 18 were previously cancelled.

Claims 1, 3, 6-10 and 24 are cancelled.

* * * * *